US005252031A

United States Patent [19]

Gibbs

[11] Patent Number: 5,252,031

[45] Date of Patent: Oct. 12, 1993

[54] MONITORING AND PUMP-OFF CONTROL WITH DOWNHOLE PUMP CARDS

[76] Inventor: Sam G. Gibbs, 2826 Marmon Dr., Midland, Tex. 79705

[21] Appl. No.: 871,859

[22] Filed: Apr. 21, 1992

[51] Int. Cl.[5] ..... F04B 49/02; E21B 47/00

[52] U.S. Cl. ..... 417/53; 417/18; 73/151

[58] Field of Search ..... 73/151; 417/53, 18

[56] References Cited

U.S. PATENT DOCUMENTS

| | | | |
|---|---|---|---|
| 3,343,409 | 9/1967 | Gibbs . | |
| 3,765,234 | 10/1973 | Sievert | 73/151 |
| 3,951,209 | 4/1976 | Gibbs | 73/151 |
| 4,015,469 | 4/1977 | Womack | 73/151 |
| 4,490,094 | 12/1984 | Gibbx . | |
| 4,583,915 | 4/1986 | Montgomery et al. . | |
| 5,044,888 | 9/1991 | Hester, II . | |
| 5,064,349 | 11/1991 | Turner et al. | 417/53 |

OTHER PUBLICATIONS

S. G. Gibbs and A. B. Neely; computer diagnosis of down-hole conditions in Sucker Rod Pumping Wells Jan. 1966, Journal of Petroleum Technology; pp. 91-98.

L. D. Patton; a computer technique for analyzing pumping well performances, Mar. 1968, Journal of Petroleum Technology, pp.243-249.

*Primary Examiner*—Richard A. Bertsch

*Assistant Examiner*—Roland McAndrews

[57] ABSTRACT

A method for monitoring a rod pumped well to detect various problems, i.e., fluid pound, rod parts, pump problems, high fluid levels, imbalance of the pumping unit, rate of production and others. The method utilizes measurements made at the surface to calculate a downhole pump card. The method utilizes the downhole pump card to detect the various pump problems and control the pumping unit.

17 Claims, 6 Drawing Sheets

MONITORING AND PUMP-OFF CONTROL WITH DOWNHOLE PUMP CARDS

BACKGROUND OF THE INVENTION

The present invention relates to oil wells and particularly to wells that are produced by rod pumping. The term 'rod pumping' refers to a pumping system in which a reciprocating pump located at the bottom of the well is actuated by a string of rods. The rods are reciprocated by a pumping unit located at the surface. The unit may be of the predominant beam type or any other type that reciprocates the rod string. A beam pumping unit utilizes a walking beam pivotally mounted on a Samson post with one end of the beam being attached to the rods and with the beam being reciprocated by a drive unit. The drive unit consists of a prime mover connected to a reduction unit that drives a crank to reciprocate the walking beam.

The downhole pump consists of a barrel attached to (or part of) the production tubing string that is anchored to the well casing. A plunger reciprocates in the barrel which is attached to the end of the rod string. The barrel is provided with a standing valve, and the plunger is provided with a traveling valve. On the down stroke, the traveling valve opens and the standing valve closes, allowing the fluid in the barrel to pass through the plunger. On the up stroke the traveling valve closes allowing the plunger to lift fluid to the surface while the standing valve opens and the plunger draws more fluid from the well into the barrel.

Pumping systems are normally sized so that they can produce essentially all of the fluid from the well using controllers which alternately pump the well or shut it down when necessary to allow more fluid to enter the casing. The controllers can be simple clock timers that start and stop the pumping unit in response to a set program or controllers that control the pumping unit in response to some measured characteristics of the pumping system.

Controllers that control the pumping unit in response to measured pumping characteristics are designed to shut the pumping unit down when the well has pumped off. This saves energy and prevents damage to the pumping system. The term pumped-off is used to describe the condition where the fluid level in the well is not sufficient to completely fill the pump barrel on the upstroke. On the next downstroke the plunger will impact the fluid in the incompletely filled barrel and send shock waves through the rod string and other components of the pumping system. This can cause harm to the pumping system such as broken rods or damage to the drive unit or downhole pump. All pump-off controllers are designed to detect when a well pumps off and to shut the well down.

In the Applicant's prior U.S. Pat. No. 3,951,209, there is described a controller that measures at the surface both the load on the rod string and the displacement of the rod string. From these measurements, one can obtain a surface dynamometer card and the area of the card will be the power input to the rod string. Since the pumping system will be lifting less fluid when the well pumps off, the power input to the rod string will also decrease. The decrease in power will result in a decrease in the area of the surface dynamometer card. This decrease in area is used as an indication of a pump-off condition and the pumping unit is shut down. U.S. Pat. No. 4,015,469 describes an improvement of the '209 patent in which only a portion of the area of the surface card is considered. In particular, the '469 patent utilizes only the last part of the upstroke and the first part of the downstroke to detect pump-off. This is the portion of the surface card in which pump-off is usually shown.

Other methods have also been developed for detecting pump off. For example, U.S. Pat. No. 3,306,210 discloses a pump-off controller that monitors the load on the polished rod at a set position in the downstroke. Pump-off is detected when the load exceeds a preset level at that set position. U.S. Pat. No. 4,583,915 discloses a pump-off controller that monitors an area outside the surface dynamometer card. More particularly, the patent discloses monitoring an area between the minimum load line and the load line at the top of the stroke. Other pump-off controllers have monitored the electrical current drawn by the drive motor to detect pump-off.

The Applicant's U.S. Pat. No. 4,490,094 discloses a pump-off controller that monitors the instantaneous speed of revolution of the drive motor during a complete or portion of the cycle of the pumping unit. Pump off is sensed by calculating a motor power from measured speed which is less than motor power corresponding to a completely filled pump barrel. Both the surface load and position of the rod string can also be determined from the monitored instantaneous speed of the drive motor.

SUMMARY OF THE INVENTION

The present invention determines pump-off by monitoring the down hole pump card instead of the surface card as described in the prior art. The use of the downhole pump card eliminates errors caused by ambiguities in the surface card and obscuring effects of downhole friction along the rods. The use of the downhole pump card, in addition, permits the controller to detect additional malfunctions of the pumping unit that are difficult to detect when surface cards are used. For example, the fluid production of the well can be calculated from the pump card and when compared to the actual production will detect a leak in the production tubing string. The downhole card will also allow the controller to monitor for possible slipping of the tubing anchor. In addition, the use of the downhole card will provide more accurate sensing of high fluid levels and gas interference.

In addition to providing for conventional starting and stopping of the pumping unit to control the well, the invention can also control the well by varying the pumping speed. The pumping speed is varied in response to the change in a selected parameter of the downhole pump card. The parameter may be the area or portion of the area inside or outside of a downhole card. Likewise, the parameter may be the change in the net liquid stroke of the pump.

The invention utilizes the surface measurements of load and displacement of the rod string to calculate the downhole card. These measurements can be direct measurements using load and position transducers or indirect measurements as described in the Applicant's prior U.S. Pat. No. 4,490,094. The invention provides a method for correcting and converting the measurements described in patent '094 into rod position measurements that correlate with load measurements. This provides a series of load-displacement measurements from which the downhole card can be calculated.

The downhole pump card can be obtained using several methods including the method described in Applicant's U.S. Pat. No. 3,343,409. This method utilizes surface measurements of load and position of the rod string to construct a downhole pump card. The downhole card is obtained by the use of a computer to solve a mathematical expression described in the patent. An alternative is to construct an analog circuit of the pumping system. It will be appreciated that while an analog circuit provides an instantaneous downhole card, it is unique to the particular pumping system. Thus, it must be changed for each pumping system.

The invention preferably uses a special purpose microprocessor-based controller or a general purpose remote terminal unit (RTU) that can be programmed to incorporate the present invention. These units are offered for sale by various manufacturers and can be made functional by installing a properly programmed EPROM.

BRIEF DESCRIPTION OF THE DRAWINGS

The present invention will be more easily understood from the following description when taken in conjunction with the drawings in which.

DESCRIPTION OF A PREFERRED EMBODIMENT

Figure 1:
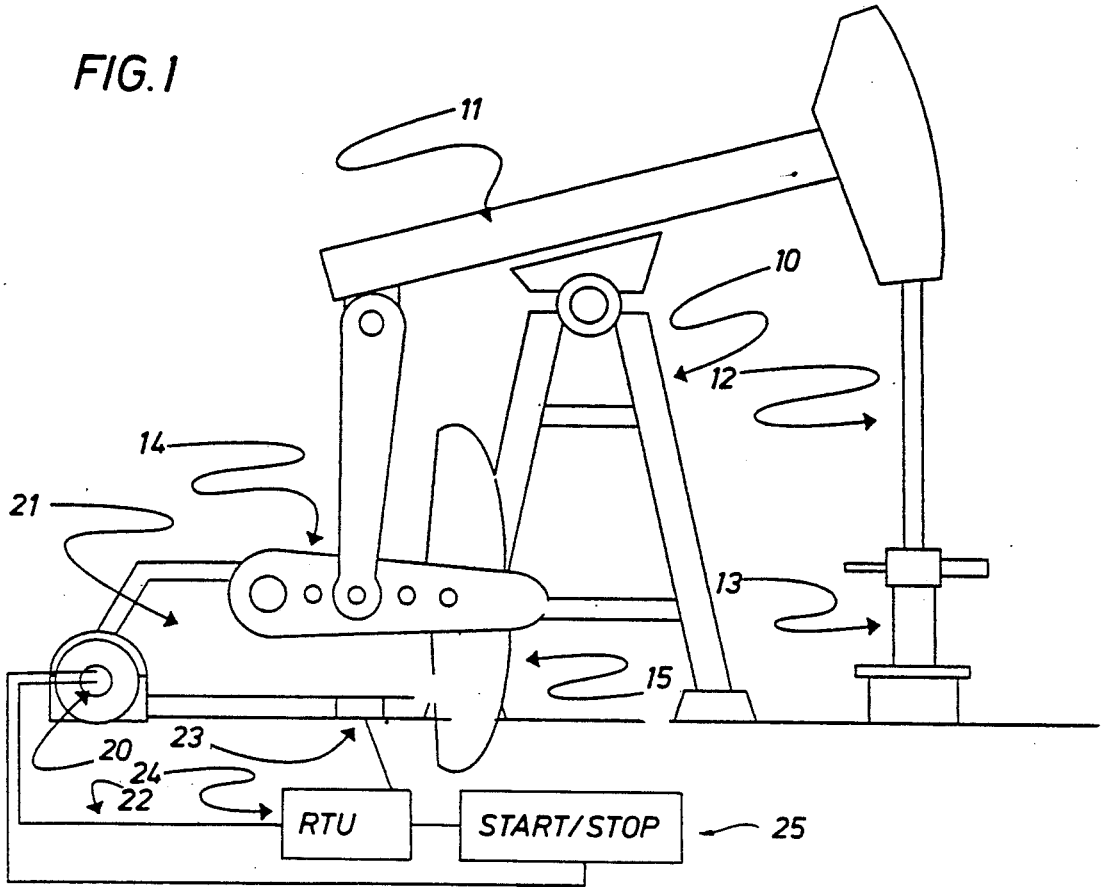
FIG. 1 is a conventional pumping unit with the present invention.

Referring now to FIG. 1, there is shown a surface pumping unit 10 used for producing the oil well 13. While a conventional beam pumping unit is shown, the method is applicable to any system that reciprocates a rod string including tower type units which involve cables, belts, chains and hydraulic or pneumatic power systems. Pumping unit 10 has a walking beam 11 which reciprocates a rod string 12 for actuating the downhole pump disposed at the bottom of the well. The pump is a reciprocating type having a plunger attached to the end of the rod string and a barrel which is attached to the end of (or is part of) the production tubing in the well. The plunger has a traveling valve and a standing valve is positioned at the bottom of the barrel. On the upstroke of the pump, the traveling valve closes and lifts the fluid above the plunger to the top of the well and the standing valve opens and allows additional fluid from the reservoir to flow into the pump barrel. On the downstroke, the traveling valve opens while the standing valve closes allowing the fluid in the pump to pass upward through the plunger into the production tubing. The well is said to be pumped-off when the pump barrel does not completely fill with fluid on the upstroke of the plunger. On the next downstroke, the plunger will contact the fluid in the incompletely filled barrel at which point the traveling valve will open. The impact between plunger and fluid will cause a sudden shock to travel through the rod string and the pumping unit. This mechanical shock can, of course, cause damage to the rod string and other pumping equipment. Thus, an effort is made to shut down the well when it reaches a pumped-off condition to prevent damage to the equipment as well as save power.

The walking beam is reciprocated by a crank arm 14 which is attached to the walking beam. The crank arm is provided with a counterweight 15 that serves to balance the rod string that is also suspended from the walking beam. The crank arm 14 is driven by an electric motor 20 connected to a gear reduction 21. The present invention can utilize the instantaneous motor speed which is indicated as a signal 22 and a monitored position of the pumping unit to help determine when the well is pumped off. The position of the pumping unit can be detected by a sensor 23 which detects the passage of the crank 14 of the pumping unit. This sensing unit can be either magnetic or Hall effect type unit, or it could be a switch which is closed by the passage of the crank or counterweight. The invention can also be implemented with direct measuring position transducers.

The load and motor speed and crank sensor signals are supplied to a special controller or remote terminal unit 24 that comprises a microprocessor and associated circuitry. The microprocessor can be programmed directly by using a keyboard which is attached to the microprocessor or by using a laptop computer which is temporarily attached to the microprocessor or by using a radio system for remote programming. The controller is coupled to a start-stop circuit 25 which starts and stops the motor 20 in response to signals received from the controller.

The data collected from the motor speed and the position of the pumping unit can be converted to load on the rod string and position of the rod string following the method described in Applicant's U.S. Pat. No. 4,490,094. Once the data is converted it will form a series of load and position data pairs that can be used to calculate a surface card. The downhole pump card can be calculated following the method described in the Applicant's prior U.S. Pat. No. 3,343,409. However, load from motor speed is usually not accurate enough to calculate a pump card. Load from a load cell at the polished rod is preferred. Both the conversion of the data and the calculating of the downhole pump card can be accomplished by the controller 24. The controller can be programmed as described above, either by using an EPROM which provides the proper instructions for the microprocessor unit or by programming a memory circuit in the controller by means of a keyboard temporarily attached to the controller. The controller comprises a small computer which has sufficient memory capacity to store data and contain the computational algorithms.

While the method described in the Applicant's prior U.S. Pat. No. 4,490,094 can be used for relating the motor speed to polished rod load, the method can also be used to determine polished rod position. To determine a starting point a signaling device is used to signal a particular position of the pumping unit. This is obtained by the signaling device 23 shown in FIG. 1. Preferably, this signal is obtained at a known position, for example, the bottom of the stroke of the pumping unit. Using motor revolutions and unit geometry the position of the polished rod for various positions of the crank (or some other movable member of the pumping unit, i.e., the beam or the pitman) is calculated starting at the known point. Thus, one will obtain a table of values in which the crank position in degrees will be related to the polished rod position in inches starting from the known position. If this is the bottom of the stroke, then zero crank angle will equal zero rod position and at 180 degrees, the polished rod will be near the top of the stroke for normal pumping unit geometry. Having these values, one can then determine the crank position for various revolutions of the drive motor using the expression:

$$\theta = \frac{360\,K}{N}$$

wherein $\theta$=crank position starting at known position

N=number of revolutions of the motor per stroke of pumping unit.

K=motor revolutions since beginning at known position. The position of the polished rod can be readily calculated by determining the crank angle for any known number of motor revolutions and referring to the precalculated values to obtain the surface rod position.

While the above description relates to the use of motor revolutions and pumping unit geometry for determining both the surface rod position and load on the polished rod at various positions, other methods may be used. For example, the method using a position transducer and load transducer described in the Applicant's U.S. Pat. No. 3,951,209 may be used. Obviously, if the rod position and load are measured at a series of points, it will not be necessary to convert the data since the measurements will provide the load and position data points required for computing the downhole card. Inferring surface position from motor revolutions and unit geometry has the practical advantage of eliminating the initial and maintenance cost of a direct measuring transducer.

Figure 2A:
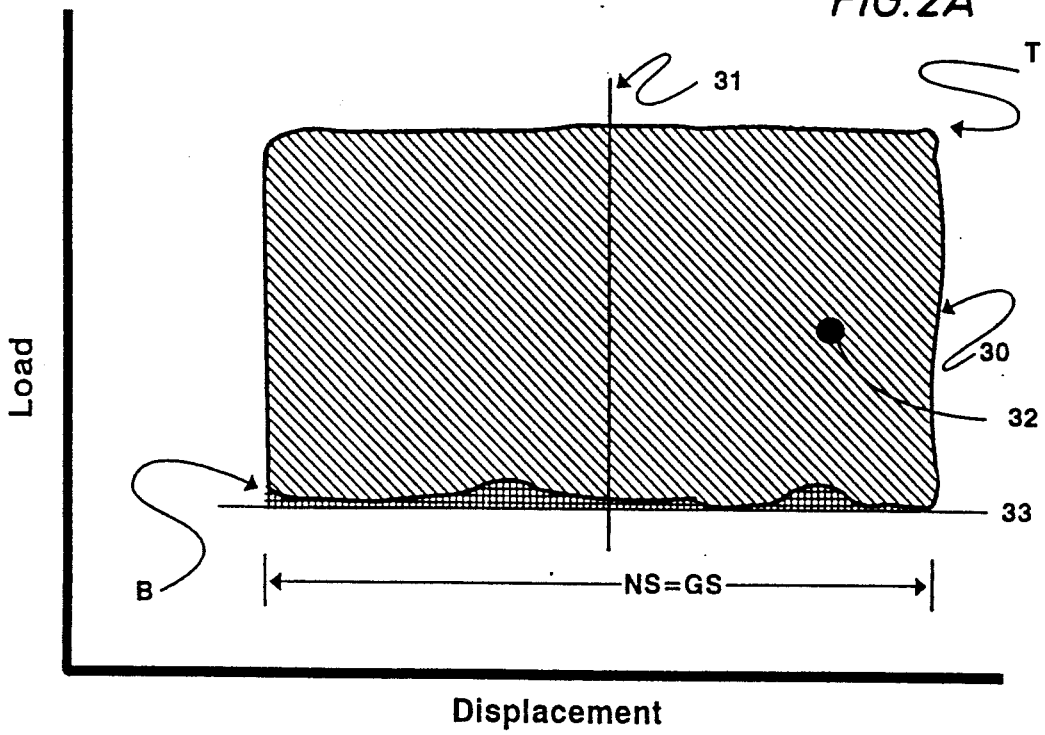
FIGS. 2A and 2B are downhole pump cards illustrating a full pump and a partially filled pump, respectively.
Figure 2B:
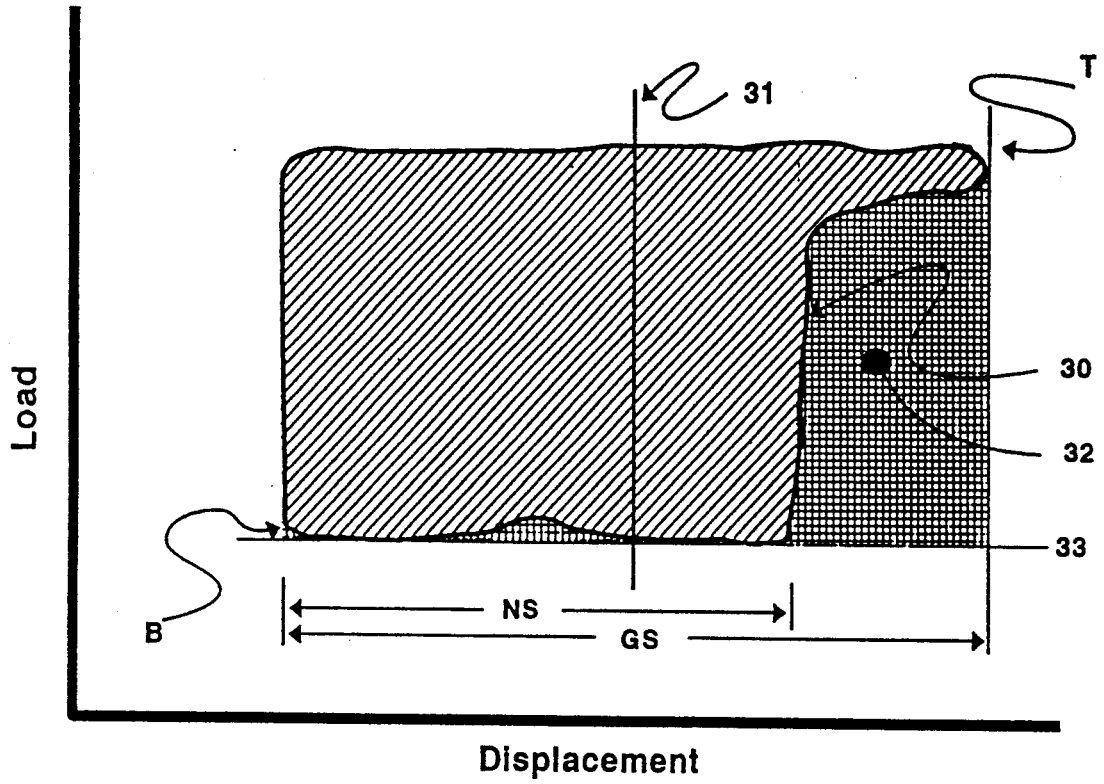

Referring now to FIG. 2A, there is shown a downhole pump card for a full pump and a pump that is partially filled and pumped off in FIG. 2B. Referring to the Figures, the line 30 represents the load on the pump rod plotted against the displacement of the pump. Line 30 is called the downhole pump card. The single cross-hatched area represents the power or energy required for lifting fluid by the pump. The pumping off can be determined by various methods. For example, one could monitor the area of the pump card to the right of the position line 31 and when this area has been reduced by a certain percentage, the well will be deemed pumped off. Likewise, one could measure the downstroke area outside the pump card above a load line, for example, line 33. In this case, pump off would be determined when the area increases by a preset amount (see the double cross-hatched areas). Referring to FIG. 2B, pump off could also be sensed when net liquid stroke NS becomes less than gross stroke GS by a preset amount. Still another way to detect pump off using FIGS. 2A and 2B is to compare the inside areas to the right and left of an arbitrarily selected line 31. The unit would be shut down when the areas differed by a preset amount. Areas beneath the downstroke load trace and above an arbitrarily selected load line to the right and left of line 31 can also be used to cause shut down (refer to the double cross-hatched areas on FIGS. 2A and 2B). Similarly, pump off could be determined by monitoring the load at a fixed or predetermined position in the downstroke to determine when the load exceeds a preset load. This is illustrated by the point 32 in the two pump cards. When the load on the downstroke exceeds the preset load at the position 32, the well will be deemed to have pumped off. The pumping off of the well could also be determined by comparing the total area of the pump card and monitoring it to detect pump off. As can be seen from FIGS. 2A and 2B, the determining of pump off by measuring the area to the right of the position line 31 is much more sensitive than utilizing the total area of the pump card for determining pump off.

The use of downhole pump cards to determine when a well has pumped off also provides the additional advantage of determining the actual quantity of fluid being lifted by the pump. This is important since it will allow one to determine if the production tubing string in the well has a leak or if the production test is correct. By comparing the calculated fluid lifted by the pump with the measured production from the well, one can determine if fluid is being lost through leaks in the production tubing. The fluid lifted by the pump can be determined by utilizing the net stroke of the pump as indicated by the dimension NS in FIGS. 2A and 2B using the following formula $$P=0.1166\ (NS)\ (SPM)\alpha D^2)$$

In the above expression, P is the instantaneous production rate in barrels per day, SPM is the pumping speed in strokes per minute and D is the diameter of the downhole pump in inches. The daily production rate can be determined by considering the pump fillage (determined from NS) and the amount of time pumped with various pump fillages.

Figure 3:
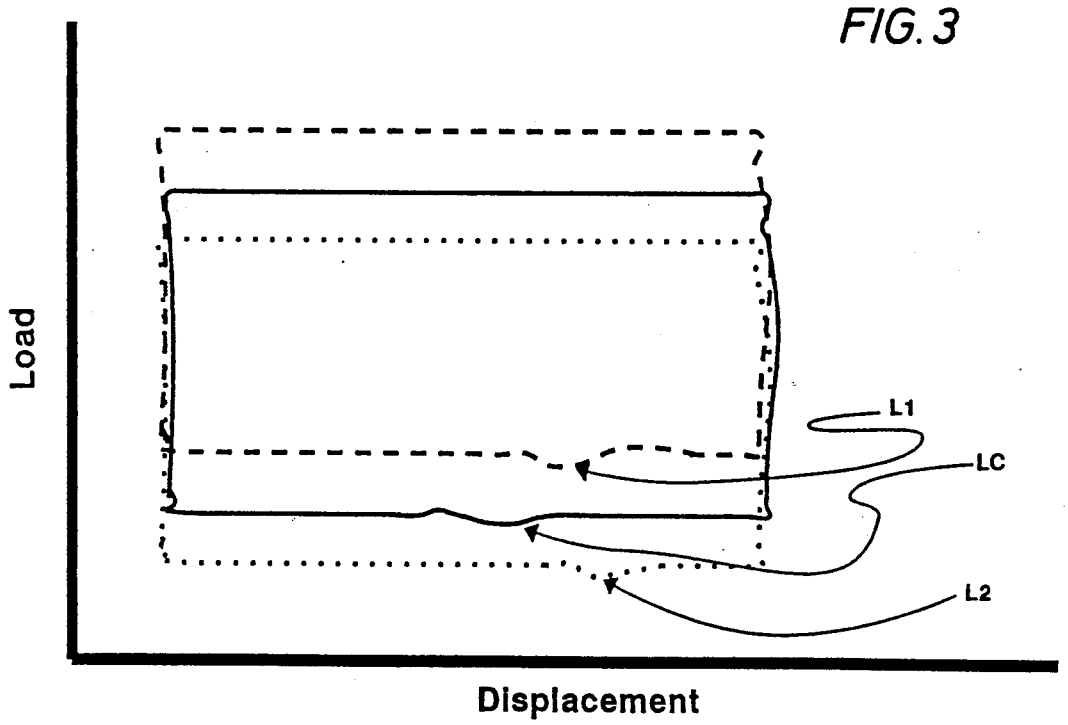
FIG. 3 is a downhole pump card illustrating the shift in load values in response to a shift in the zero offset of surface load transducers.

Referring to FIG. 3, there is shown a series of pump cards that are reproduced as a result of the zero load offset of the load cell changing due to temperature changes or other factors which affect the load cell. If the speed of the motor is used as described with reference to FIG. 1 for determining the load and position of the rod string, the following method will not be required for correcting the data. Likewise, if polished rod mounted load cells are used as described in the Applicant's previously issued U.S. Pat. No. 3,951,209, no correction will usually be required. Correction is often required for the use of beam mounted load cells in which the zero load offset changes as the temperature of the beam changes. As shown in FIG. 3, there are three separate pump cards, each of which have a minimum load point $L_c$ (correct loads), $L_2$(loads too high) and $L_2$ (loads too low). The new zero load offset for the load cell is determined by calculating the change in the load offset L by subtracting the minimum load $L_2$, or $L_2$ from the reference minimum load $L_c$. The reference minimum load on the pump card can be obtained by temporarily inserting in the rod string a calibrated polished rod mounted load cell to determine a pump card with the correct reference minimum load, $L_c$. Once the reference load $L_c$ is determined, it is retained in the controller. The zero load offset of the beam mounted load cell can be corrected by algebraically adding L to all loads. It is preferable that a correction is made only when the change in the offset L exceeds a preset amount. This will prevent trivial changes in the zero offset of the load cell. Likewise, it is preferable to limit the maximum amount by which the zero load offset can be changed for each stroke of the pump. This will prevent the zero load offset from being changed in response to a minimum load that is a violation of a preset minimum load in the pump off controller.

Figure 4:
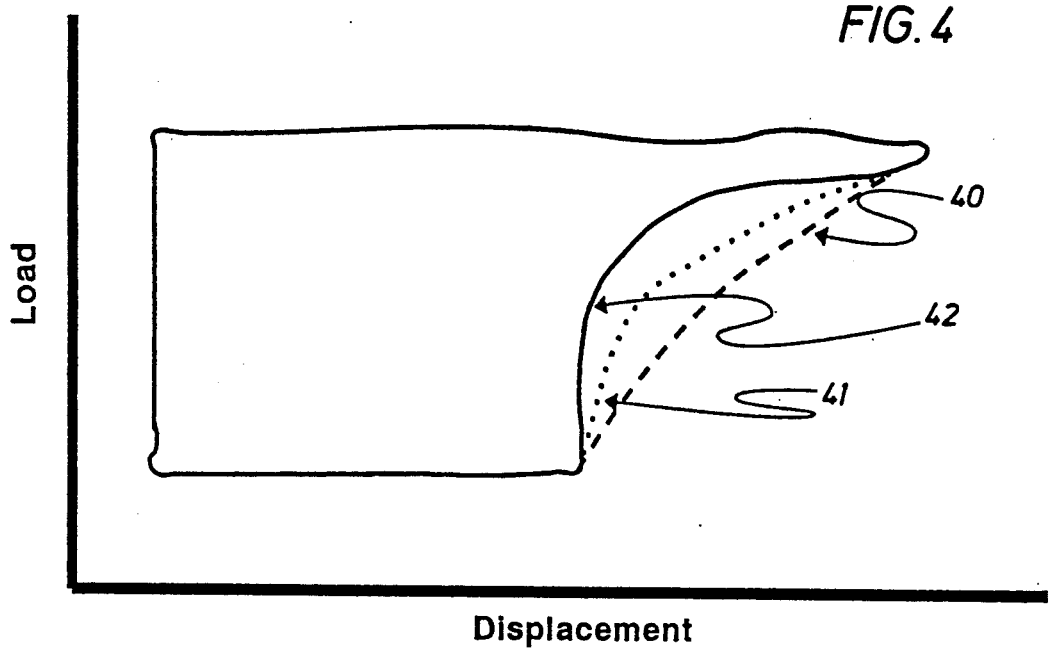
FIG. 4 is a downhole card showing different pressures within the pump and how these pressures affect a shape of the pump card.

Referring to FIG. 4, there is shown a downhole pump card in which the pump has considerable gas in the fluid filling the pump. High pressure gas in the well fluid, called gas interference, is normally not a reason for shutting down the pumping unit. Under these conditions no fluid pound will occur and there is no need to shut down the pumping unit although it must be monitored to detect the occurrence of pump off. As shown by the curves 40, 41 and 42 the gas is compressed in the initial portion of the downstroke until the pressure equals the fluid pressure at the foot of the well's tubing. The curve 41 is taken as the compression curve (pump load release line) for a pumped off well at a selected pump intake pressure as follows:

$$PL = A\,(Pa - Pb)$$

where

A = area of pump, sq inches

PL = pump load, lbs

Pa = pressure above plunger at foot of tubing, psi

Pb = pressure in pump below plunger, psi $Pb = C/(A\,(GS - NS - X))^n$, psi

X = distance measured downward from top of stroke, inches $C = PIP(A\,(GS - NS))^n$ n = polytropic exponent for gas compression (say 1.25)

PIP = preset pump intake pressure, psi

GS = gross stroke from pump card, inches

NS = net liquid stroke from pump card, inches

Under normal operating conditions low pressure gas will be removed from the well fluid and the well can be pumped off and should be shut down. Under some conditions, high pressure gas in the fluid will not be removed as the pump operates (a condition called gas interference) and it is not possible for the well to pump off. In this case the well should not be shut down because production would be lost. The magnitude of pump intake pressure affects the curvature of the load release curve shown on the pump card. This is illustrated by the curves 40, 41, 42 of FIG. 4. Pump intake pressure along curve 40 exceeds pump intake pressure along curve 41 which exceeds pump intake pressure along curve 42. The present invention thus has the ability to discern between pump off which calls for shut down and gas interference which calls for continuous pumping. A reference load release curve 41 is established by selecting a desired pump intake pressure and liquid fillage at shut down. Then monitoring for pump off is done by continually comparing the load release traces to the reference trace 41. If the release trace 42 is above the reference trace, the well is said to have pumped off and is shut down. If the release trace 40 shown by the pump card is below the reference trace, gas interference is known to be occurring and pumping is continued. The microprocessor used in the pump off controller can be programmed to make the above calculation for the reference load release curve 41.

Figure 5:
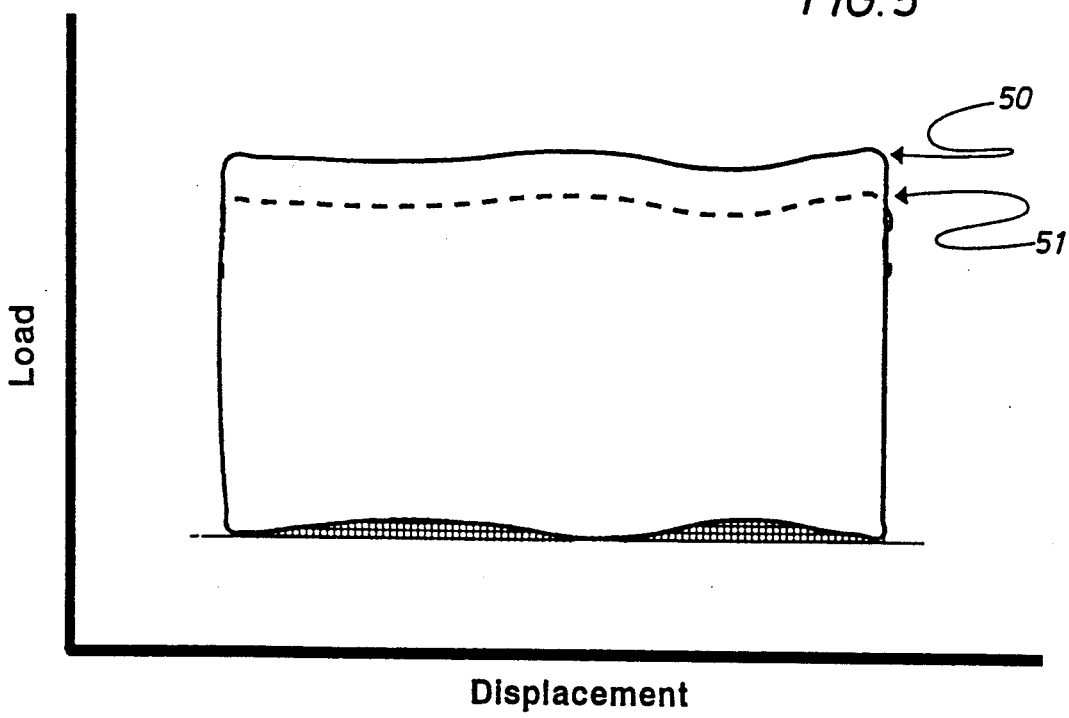
FIG. 5 is a downhole card for a well having high fluid levels.

Another condition that occurs in wells is the condition called high fluid level. This condition normally occurs when the well has been shut down for an extended period of time and more formation fluid builds up in the well bore than would normally build up during the normal shut down periods of the pumping unit. Under these conditions less work is required to lift the fluid to the surface since the distance which the fluid must be lifted is decreased. This condition is illustrated in FIG. 5 where the curve 50 corresponds to a full downhole pump with a normal low fluid level in the well and the curve 51 indicates the downhole pump card with a higher than normal fluid level in the well. The area inside the pump card represents pump work or power and is less in the high fluid level condition. The double cross-hatched area outside of the pump card between the downstroke load line and a load line passing through the minimum load point on the downhole pump card will remain substantially constant regardless of the fluid level in the well. Compare this area with the larger double cross hatched area shown in FIG. 2B for a pumped off well with a low fluid level. This also shows that it is possible to determine a pumped off condition by measuring the area outside of the pump card as described above.

A second method for determining when a high fluid level exists uses the computed fluid load FL on the downhole pump. Using the pump card the fluid load is determined by subtracting the minimum load from the maximum load. The minimum load is calculated as the average pump load over a selected portion of the down stroke. Similarly the maximum load is calculated as the average pump load over a selected portion of the up stroke. As fluid level rises, fluid load decreases as shown in FIG. 5. The fluid load on the pump is calculated for normal operating conditions and stored in memory. Upon succeeding startups of the pumping unit after a shutdown period, the fluid load can be calculated and compared to the stored reference fluid load. If the calculated fluid load is substantially less than the stored reference value of the fluid load, the well has a high fluid level and is not pumped off and pumping should be continued. When the calculated fluid load approaches the stored fluid load reference value, one should monitor the well for a pumped off condition using any of the methods described above.

Figure 6:
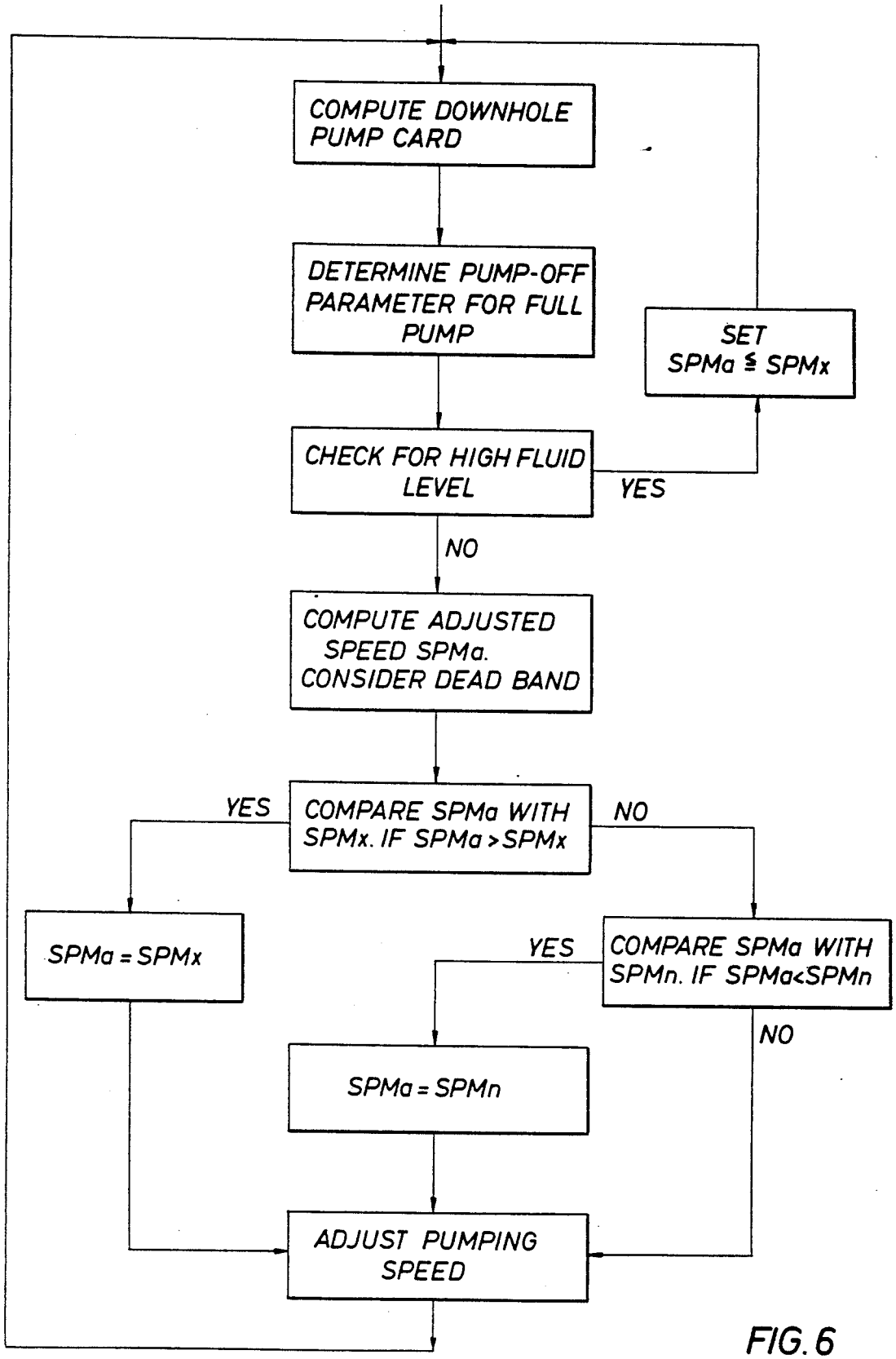
FIG. 6 illustrates the logic of a variable speed pumping unit control.

Referring now to FIG. 6 there is shown the logic for using a downhole pump card to control the speed of the pumping unit so that the pumping rate matches the rate at which fluid flows into the well. Using today's technology, it is possible to control the speed of the drive motor of a pumping unit using methods such as eddy current drives, variable frequency drives or variable sheave devices. By using the downhole pump card the desired speed of the pump can be determined to maintain near complete pump fillage.

As shown in FIG. 6, the downhole pump card is first calculated from data collected at the surface using the method described in the Applicant's prior patent or any other suitable method. Selected parameters are identified such as total area A within the card, net liquid stroke NS, present pumping speed SPMp and fluid load FL. Then the existence of high fluid level is checked using a remembered fluid load on the verge of pump-off FLf or by using the area below the down stroke trace as previously described. If a high fluid level is found, pumping speed is increased by a selected amount not to exceed the preset maximum speed SPMx and the process is continued by calculating another pump card. If fluid level is not high, an adjusted speed SPMa is calculated using any of the methods described herein including $$SPMa = A\ SPMp/Af$$

where Af is the remembered card area when the pump was full but on the verge of pump off. An alternate formula for adjusting pumping speed is $$SPMa = NS\ SPMp/GS$$

where GS is the remembered gross stroke when the pump was full. The adjusted speed is not allowed to exceed maximum allowed speed SPMx or to be less than minimum allowed speed SPMn. The adjusted speed is also compared to previous speed in a dead band comparator to eliminate trivial changes. A signal is then sent to the prime mover to change speed to the adjusted value SPMa. The selected parameters are updated to allow for changing conditions. The adjusted speed becomes the present speed. If pump card area exceeds the remembered value then the remembered value becomes the newly calculated pump card area. If the newly determined fluid load exceeds the remembered value, the remembered value becomes the newly computed fluid load. If the newly calculated net stroke exceeds the remembered gross stroke, the remembered gross stroke becomes the newly computed net stroke. Then another pump card is calculated and the process is repeated. In using the above logic, it is obvious that the maximum speed of the pumping unit will be controlled by mechanical parameters and the maximum speed capability of the drive motor. Likewise, the minimum speed should be set at some level which will allow sufficient range of adjustment to match the pumping speed to the rate at which fluid is flowing into the well. This is easily accomplished with present motors which allow adjustment of speed near zero to the maximum attainable by the motor.

Figure 7:
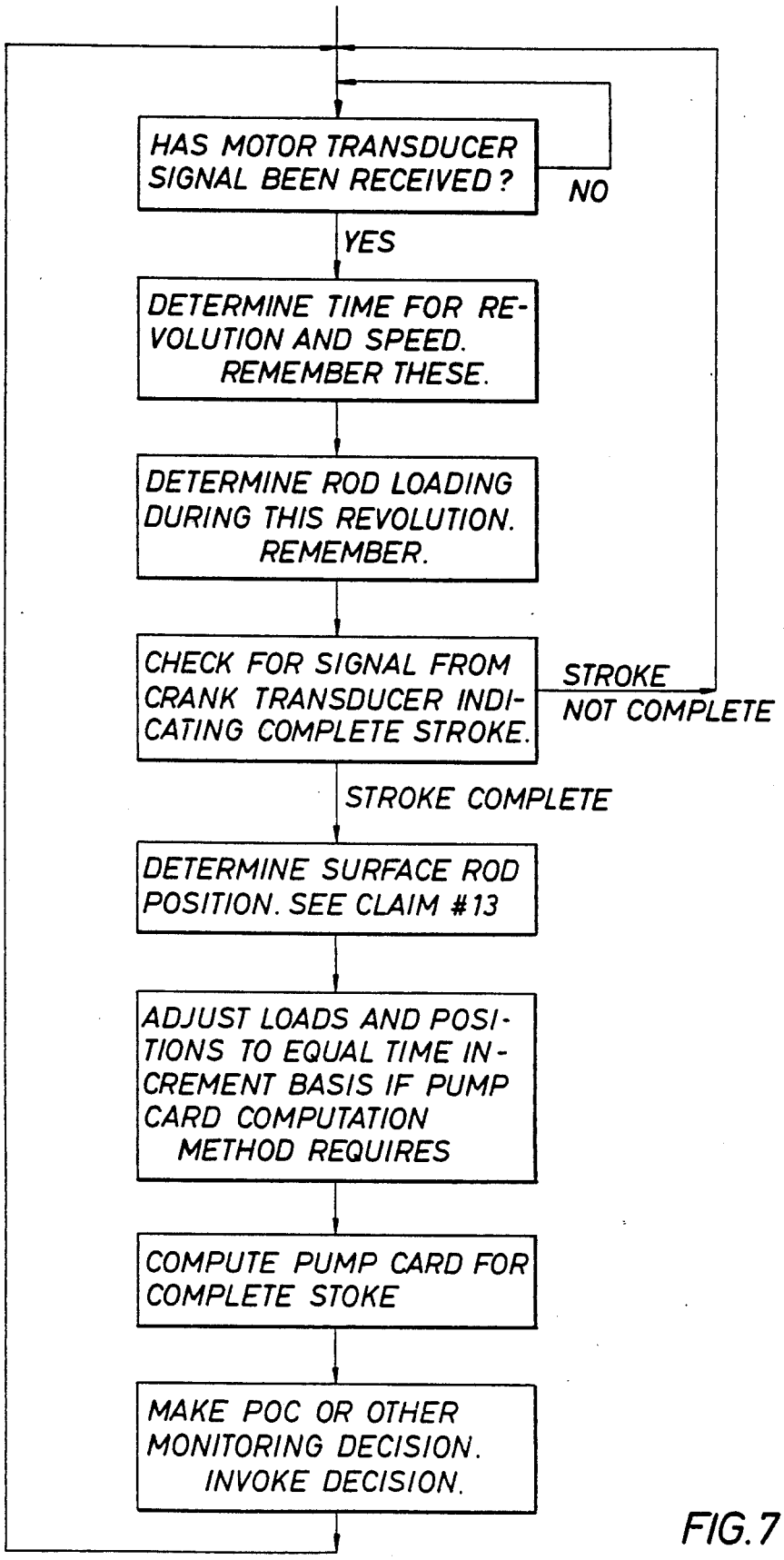
FIG. 7 shows the logic of gathering data by converting a motor characteristic to load and position during a complete stroke of the pumping unit.

Referring now to FIG. 7, a method is revealed as to how data is collected for computing pump cards using unit geometry and revolutions of selected drive train components. The microprocessor is continually waiting for interrupt signals from transducers mounted on the motor and pumping unit crank. When a signal from the motor is sensed, the processor knows that the motor has made a revolution from which motor speed can be determined from the time required to make a revolution. This motor speed and revolution time are remembered. As soon as possible after a motor revolution is completed, surface rod load is measured and remembered. The process is continued by measuring and remembering motor speed, revolution time and load for successive revolutions until an interrupt from the crank transducer signals that a complete stroke of the unit has occurred. Then as revealed in this invention, motor revolutions and pumping unit geometry are used to compute surface rod position. The computational process for pump cards usually requires that surface rod and position data be gathered at equal time increments. If so required, the data gathered revolution by revolution (not at equal time increments because of variations in motor speed) is adjusted to an equal time basis by interpolation. Then as FIG. 7 further shows, a pump card is computed and an operational decision based on this invention is made to stop the unit, continue pumping as is or alter pumping speed. The process is thereby continued.

Figure 8:
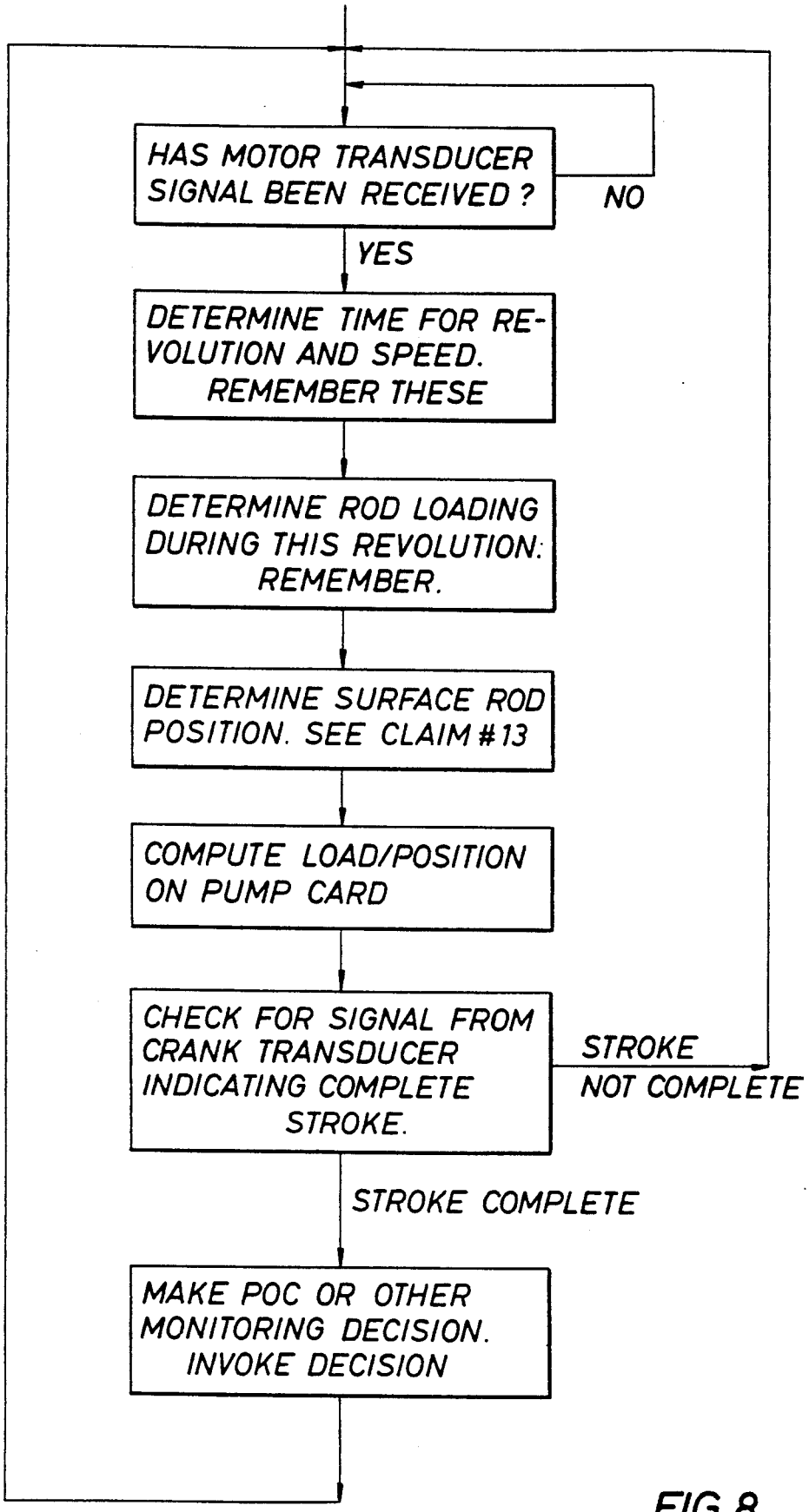
FIG. 8 illustrates the logic of gathering data point by point to permit calculation of a real time pump card.

FIG. 8 shows a process for gathering data and computing pump cards on a real time basis using unit geometry and sensors on rotating components of the drive train. As previously described, the transducer on the motor signals completion of a motor revolution at which time load is measured and position is inferred from unit geometry. Then, a load-position point on the downhole pump card is computed. This requires a fast pump card algorithm which can produce a computed load-position pair before the motor completes another revolution. At 1200 motor revolutions per minute, this allows less than 0.050 seconds for all of the computations. The process is continued revolution after revolution until a crank transducer interrupt is received which indicates afull cycle of the unit has been completed and a complete pump card has been constructed. At this time, operational decisions are made according to this invention. The advantage of the real time calculation is that distortion of the pump card due to non-steady conditions does not occur.

What I claim is:

1. A method for detecting a pumped off condition in a rod pumped well wherein the rod is reciprocated by a pumping unit located at the surface, said method comprising;

measuring at the surface an operating characteristic of the pumping unit;

determining from the measured operating characteristic the load on a polished rod and the position of the polished rod at a plurality of positions of the polished rod for a complete stroke of the pumping unit;

selecting a cycle of the pumping unit to use as a reference and utilizing the load and position data during said selected cycle to calculate a downhole pump card;

determining the inside area of downhole pump card to establish a reference area;

continuing to calculate and monitor the inside area of the downhole pump card;

shutting down the pumping unit when the calculated area decreases by a predetermined amount below the reference area; and restarting the pumping unit after a predetermined shut down period.

2. The method of claim 1 wherein the reference area is a selected portion of the total area of the downhole pump card.

3. The method of claim 1 wherein the pumping unit is shut down when the inside area to the left of an arbitrarily selected line differs by a preset amount from the inside area to the right of that line.

4. A method for detecting a pumped off condition in a rod pumped well wherein the rod is reciprocated by a pumping unit located at the surface, said method comprising:

a) measuring at the surface at least one operating characteristic of the pumping unit;

b) determining from the measured operating characteristic the load on a polished rod and position of the polished rod at the plurality of positions of the polished rod for a complete cycle of the pumping unit;

c) selecting a cycle of the pumping unit to use as a reference and utilizing the determined load and rod position during the selected cycle to calculate a reference downhole pump card;

d) identifying a reference load line on said reference downhole pump card;

e) calculating the area below the pump card between the reference load line and the downstroke load line on the reference downhole pump card;

f) shutting down said pumping unit when the calculated area increases a preset amount; and g) restarting said pumping unit after a preset shut down period.

5. The method of claim 4 wherein said measured area below the pump card to the left of a vertical line differs by a preset amount from the area below the pump card to the right of the vertical line.

6. The method of claim 4 wherein said measured operating characteristic is the speed of the motor driving the pumping unit and a reference signal that relates to a predetermined position of the rod.

7. A method for detecting a pumped off condition in a rod pumped well wherein the rod is reciprocated by a pumping unit located at the surface, said method comprising:

measuring at the surface at least one operating characteristic of the pumping unit;

determining from the measured operating characteristic the load on a polished rod and position of the polished rod at the plurality of positions of the polished rod for a complete cycle of the pumping unit;

selecting a cycle of the pumping unit to use as a reference and utilizing the determined load and rod position during the selected cycle to calculate a reference downhole pump card;

identifying a reference point on said downhole pump card by the crossing of a selected load and position lines, said reference point being located outside of said reference downhole pump card when said well has pumped off;

monitoring said downhole pump card as said pumping unit continues to operate and shutting down said pumping unit when said reference point falls outside of said downhole pump card; and restarting the pumping unit after a preset shut down time.

8. A method for estimating the production from a rod pumped well wherein the rod is reciprocated by a pumping unit located at the surface, said method comprising:

measuring at the surface at least one operating characteristic of the pumping unit;

determining from the measured operating characteristic the load on a polished rod and position of the polished rod at the plurality of positions of the polished rod for a complete cycle of the pumping unit;

selecting a cycle of the pumping unit to use as a reference and utilizing the determined load and rod position during the selected cycle to calculate a reference downhole pump card;

determining the net liquid stroke in inches on the downhole pump card; and calculating the instantaneous production rate using the following expression:

$$P=0.1166\ (NS)\ (SPM)\ (D^2)$$

wherein P is the instantaneous production rate in barrels per day, SPM is the pumping speed in strokes per minute and D is the diameter of the downhole pump in inches.

9. The method of claim 8 wherein daily production is calculated by considering the times pumped with various liquid fillages.

10. The method of claim 8 and in addition detecting holes in the production tubing by comparing the calculated production with the actual production.

11. The method of claim 8 including the step of detecting pump off when net liquid stroke NS is less than gross stroke GS by a preset amount.

12. A method for correcting loads from a load cell mounted on a pumping unit, said method comprising:

a) measuring at the surface at least one operating characteristic of the pumping unit;

b) determining from the measured operating characteristic the load on a polished rod and position of the polished rod at the plurality of positions of the polished rod for a complete cycle of the pumping unit;

c) selecting a cycle of the pumping unit to use as a reference and utilizing the determined load and rod position during the selected cycle to calculate a reference downhole pump card;

d) determining the minimum load on the downhole pump card and retaining as a reference load Lc;

e) continuing to perform steps a), b) and c) and determining the minimum $L_n$ on the downhole pump card;

f) calculating the change L in the minimum load by substracting the reference load Lc from the new minimum load $L_n$: and g) algebraically adding the difference to all loads when L exceeds a preset level.

13. A method for determining the position of the rod in a rod pumped well wherein the rod is reciprocated by a beam pumping unit driven by a drive train including an electric motor coupled to a reducer that drives a crank, said drive train oscillating the beam of the pumping unit, said method comprising;

detecting the rotation of some portion of the drive train;

detecting a known position of said crank;

calculating the polished rod position at the detected crank position;

using the geometry of the pumping unit to calculate the polished rod position for related angular positions of the crank, the bottom of the stroke being assigned a zero polished rod position;

calculating the crank position with reference to the number of revolutions of the rotating member, from the expression O=360 K/N wherein O is the crank position in degrees at the known position, N is the number of revolutions of the rotating member for a complete stroke of the pump and K is the revolutions of the rotating member since beginning at the known position; and determining the rod position from the previously calculated rod position versus crank angle using the expression O=360 (K/N).

14. A method for sensing a high fluid level using fluid load from a calculated pump card, said method comprising:

measuring at the surface at least one operating characteristic of a pumping unit;

determining from the measured operating characteristic the load on a polished rod and position of the polished rod at the plurality of positions of the polished rod for a complete cycle of the pumping unit;

selecting a cycle of the pumping unit to use as a reference and utilizing the determined load and rod position during the selected cycle to calculate a reference downhole pump card;

identifying as the reference downhole pump card the last downhole pump card obtained before pump off;

calculating and storing the fluid load on said reference pump card, said fluid load being the difference between average maximum and average minimum pump loads on said reference pump card;

continuing to monitor and calculate pump cards and the fluid load for each pump card;

declaring high fluid level when the most recent fluid load is less than the reference fluid load by a preset amount.

15. A method for sensing high fluid level using an area beneath the pump card, said method comprising:

measuring at the surface at least one operating characteristic of a pumping unit;

determining from the measured operating characteristic the load on a polished rod and position of the polished rod at the plurality of positions of the polished rod for a complete cycle of the pumping unit;

selecting a cycle of the pumping unit to use as a reference and utilizing the determined load and rod position during the selected cycle to calculate a reference downhole pump card;

identifying as reference load line on said reference downhole pump card;

calculating the area below the pump card between the reference load line and the downstroke load line of the reference downhole pump card;

continuing to monitor and calculate pump cards and identifying said reference area beneath the cards;

declaring high fluid level and continuing to pump as long as the calculated area has not increased above a preset value.

16. A method for gathering data for monitoring and control of a rod pumping system using unit geometry, revolution measurements for selected components of the drive system and pump cards calculated after a complete stroke, said method comprising:

sensing a complete revolution of the motor;

measuring the load on the pump rod;

determining surface rod position and measured load corresponding to this revolution;

continuing to collect and compute rod position and to measure load for successive revolutions of the motor until sensing that a complete pump cycle has been completed; and utilizing said rod position and load data to compute a downhole pump card and control the operation of the pumping unit.

17. A method for monitoring and control of a rod pumping unit based on real time computation of a downhole pump card, said method comprising:

sensing a complete revolution of the motor;

measuring the load on the pump rod;

determining surface rod position and measured load corresponding to this revolution;

computing a load-position point on the downhole pump card corresponding to this revolution using the surface rod position and load;

continuing to compute downhole pump card points revolution by revolution until a crank transducer signals completion of the stroke to obtain a complete downhole pump card; and utilizing said complete downhole pump card to control the operation of said pumping unit.

* * * * *